United States Patent [19]

Mizuno et al.

[11] 4,098,937

[45] Jul. 4, 1978

[54] TREATMENT OF FABRICS IN MACHINE DRYERS

[75] Inventors: William G. Mizuno, St. Paul, Minn.; Iris N. Henderson, Parkridge, Ill.

[73] Assignee: Economics Laboratory, Inc., St. Paul, Minn.

[21] Appl. No.: 704,459

[22] Filed: Jul. 12, 1976

Related U.S. Application Data

[60] Continuation-in-part of Ser. No. 232,432, Mar. 7, 1972, Pat. No. 4,004,685, which is a division of Ser. No. 470,565, May 16, 1974, Pat. No. 3,967,008.

[51] Int. Cl.[2] ..... B32B 7/00; B32B 9/04; D06M 11/00

[52] U.S. Cl. ..... 428/68; 206/0.5; 252/8.6; 428/247; 428/249; 428/255; 428/475; 428/485; 427/242

[58] Field of Search ..... 427/240, 242, 248, 140; 252/8.6; 428/57, 68, 72, 73, 219, 245, 255, 274, 338, 475, 485, 542

[56] References Cited

U.S. PATENT DOCUMENTS

| | | | |
|---|---|---|---|
| 3,442,692 | 5/1969 | Gaiser | 427/240 |
| 3,632,396 | 1/1972 | Perez-Zamora | 252/8.6 X |
| 3,686,025 | 8/1972 | Morton et al. | 428/247 X |
| 3,744,529 | 7/1973 | Jorda et al. | 428/255 X |
| 3,870,145 | 3/1975 | Mizuno | 252/8.6 X |
| 3,967,008 | 6/1976 | Mizuno et al. | 427/242 |
| 4,004,685 | 1/1977 | Mizuno et al. | 427/242 X |

FOREIGN PATENT DOCUMENTS

| | | |
|---|---|---|
| 1,399,728 | 7/1975 | United Kingdom. |

*Primary Examiner*—Thomas J. Herbert, Jr.
*Assistant Examiner*—R. Eugene Varndell, Jr.
*Attorney, Agent, or Firm*—Norman P. Friederichs

[57] ABSTRACT

Fabrics are treated in machine drying apparatus to reduce static electricity carried by the fabrics, soften the fabrics and improve other fabric properties. A reusable dispenser of solid or semi-solid fabric-conditioning agent is placed in the dryer drum and tumbled with the fabrics in the dryer thereby causing some of the fabric-conditioning agent to be transferred to the fabric. When the dryer is heated, the heat of the dryer helps cause the fabric-conditioning agent to soften and assist in its distribution over the surface of fabric with which it is brought into tumbling contact.

9 Claims, 3 Drawing Figures

TREATMENT OF FABRICS IN MACHINE DRYERS

CROSS REFERENCE TO RELATED APPLICATIONS

This application is a continuation-in-part of co-pending application, Ser. No. 232,432 filed Mar. 7, 1972 now U.S. Pat. No. 4,004,685 and a divisional application of said application bearing Ser. No. 470,565 filed May 16, 1974 now U.S. Pat. No. 3,967,008.

BACKGROUND OF THE INVENTION

In laundering it is common to treat various types of fabrics such as wool, cotton, silk, nylon, polyester, permanent-press, and the like with chemicals which are fabric-conditioning or treating agents to render the fabrics soft to the touch, to reduce tangling, knotting or wrinkling, to render them free of static electricity, to render them bacteria-resistant, to deodorize them, and to otherwise condition them. The use of fabric conditioners permits dried clothes to be sorted and folded more easily and quickly. These results are ordinarily achieved by introducing an aqueous solution or dispersion of the fabric-conditioning agent into the wash water during the washing cycle of the laundry process or by introducing such an aqueous solution or dispersion of fabric-conditioning agent into the rinse water during the rinsing cycle of the laundry process. Experience has shown that addition of the fabric-conditioning agents during the rinse cycle of the laundry process is often significantly more effective than addition of the fabric-conditioning agents during the wash cycle. Since some clothes washing machines do not have automatic fabric softener dispensers, a homemaker must be present during the washing of fabrics to manually add the fabric conditioner during the rinse cycle. This is inconvenient and, consequently, is often forgotten. Even when the washing machine is equipped with an automatic dispenser, the use of a fabric-conditioner is still a messy operation requiring measuring of a liquid suspension, is wasteful and is ecologically undesirable because a significant amount of the fabric conditioner is lost to the drain. Moreover, the fabric softener is usually added to the deep rinse where some soap or detergent and soil may still be present, leading to redeposition problems and interaction between the anionic detergent and cationic softeners (which are mutually incompatible), with subsequent loss of efficiency.

As a result of combinations of the above factors, a survey has shown that many homemakers use fabric softeners irregularly and on the basis of "when I remember" or "when it is needed" with equally irregular performance as regards antistatic and other fabric conditioning properties.

The use of liquid fabric conditioning agents in machine dryers has been suggested in the past, but the idea has not gained widespread commercial acceptance probably as a result of such factors as the need for complex dispensing equipment.

Recently, means and techniques have been developed for dispensing solid fabric conditioners in a machine laundry dryer. Flexible substrates coated or impregnated with a fabric softening and/or anti-static agent and designed for use in clothes dryers are now commercially available. These commercial articles are premeasured, disposable, single-use sheets and can be expensive to use. Perhaps the most severe difficulty with these coated or impregnated substrates has been the danger that they may mark or stain the clothes in the dryer. One route for overcoming this difficulty is to coat the flexible substrate with a solid chemical agent which remains solid throughout the operating temperature range of the dryer (e.g. throughout the range of 50°-90° C.). The flexing of the flexible substrate which accompanies the clothes tumbling action of a dryer drum is presently believed to cause the coating of the chemical agent to develop a flaking action, resulting in the transfer of the agent to the clothes in the form of tiny solid flakes or crystals. These flakes of the solid agent are apparently considered less likely to cause staining as compared to an agent which is molten or significantly softened within the 50°-90° C. range. This coated flexible substrate approach is believed to be best suited for single-use flexible sheets which are separated out from the dryer load after the drying cycle and then discarded.

PRIOR ART

The prior art in this area is voluminous and thirty to forty U.S. patents and many foreign patents could easily be cited. However, it is presently believed that U.S. Pat. No. 3,686,025 (Morton) issued Aug. 22, 1972 is the most important. U.S. Pat. No. 3,442,692 (Gaiser) issued May 6, 1969 is also of interest.

SUMMARY OF THE INVENTION

The present invention is based on the discovery that desired fabric properties (e.g. anti-static properties) can be obtained by treating the fabric in a machine dryer with a very small amount of a fabric-conditioning agent such as an anti-static agent, which agent is present in a solid or semi-solid, consolidated reusable form. Briefly described, the method of the present invention involves placing within the dryer a consolidated mass (as contrasted to a coating or a powder having discrete particles) of heat softenable material comprising, for example, an anti-static agent. This mass of solid fabric-conditioner is contained within a dispenser, a portion of which is permeable so that the fabric-conditioner can be released through the dispenser when it is softened by the heat of the dryer. For example, a powder anti-static agent can be placed in a closely woven fabric envelope sealed on 3 sides, which, after filling with powder, is sealed on the 4th side, and can be consolidated into a bar or other three-dimensional mass by applying pressure and/or heat to the envelope. The fabric can be woven or non-woven because the principal requirement of the envelope is that it have a permeable portion, and a wide variety of fabrics can be selected to provide the appropriate degree of permeability. Non-permeable portions of the envelope, if any, can comprise polymeric film or the like.

A particularly advantageous method of this invention involves mounting the envelope on a leading edge of one of the dryer vanes. See our co-pending application Ser. No. 232,432 filed Mar. 7, 1972 of which this application is a continuation-in-part. However, where attachment to the dryer vane is not practical (e.g. a "community" dryer in an apartment house, a dryer in a self-service laundromat) the cloth envelope can be tumbled with the clothes to obtain the advantages of the invention of Ser. No. 232,432, with the exception that the envelope must be sorted from the clothes after each cycle. Minimization of the marking and staining (which can occur if the dispenser comes in direct and prolonged contact with a particular item of clothes) can be accomplished by making the dispenser large enough so that it will not become entrapped in shirt sleeves, etc.; by using materials for the envelope which will control the permeability of the chemicals utilized; by varying the chemicals and additives used to control permeability; and/or by enclosing the dispenser in a mesh (e.g. nylon) overwrap which eliminates any direct contact between the dispenser and the clothes being dried. The consolidated, three-dimensional mass will have a softening range within the range of the dryer temperature. When the fabric to be treated is tumbled within the heated dryer drum, anti-static agent passes through pores or interstices in the permeable envelope and is transferred to the fabric.

THE DRAWINGS

DETAILED DESCRIPTION

Method of Treating Fabrics

The present method of treating fabrics in machine dryers can be understood by referring to the following description when read in conjunction with the Drawings.

In operation, a load of fabric (e.g. clothes, usually damp and ready to be dried) is placed in a dryer along with dispenser 1 and the fabric and the dispenser are tumbled together. In this manner, the fabric is brought into repeated contact with a dispensing surface of dispenser 1. The heat from the dryer causes the fabric-conditioning agent to soften and be transferred to the fabric by contact between the tumbling fabric and the dispensing surface of the dispenser 1.

It has been observed that after a dispenser has been used (e.g. a cloth or bag dispenser), beneficial anti-static properties can be obtained for a cycle or more by merely tumbling dry clothes along with dispenser 1 in an unheated dryer. Presumably, fabric-conditioner which is on the outer surface of the dispenser is transferred to the fabric through abrading contact with the fabric.

The Dispenser

Figure 1:
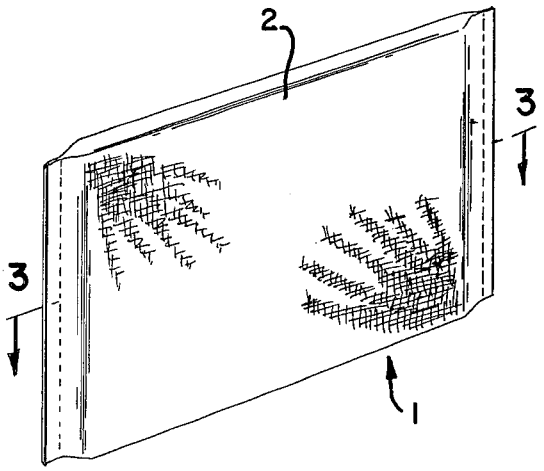
FIG. 1 is a perspective view of a cloth dispenser useful in the practice of the present invention.
Figure 2:
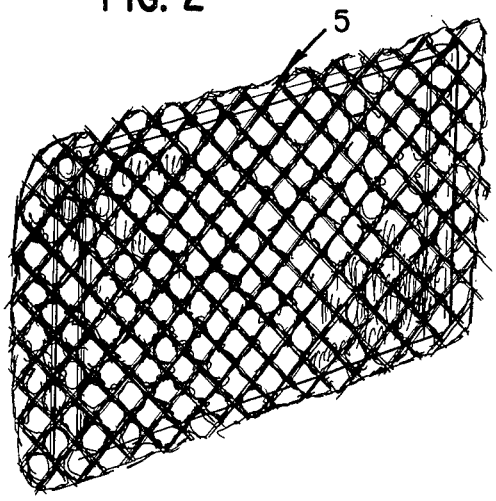
FIG. 2 is a perspective view of the cloth dispenser of FIG. 1 enclosed within a nylon mesh overwrap.
Figure 3:
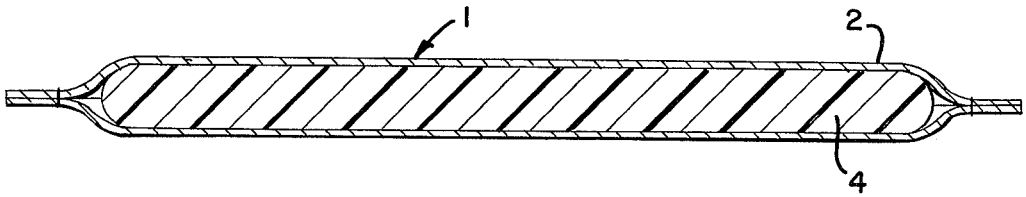
FIG. 3 is a cross-sectional view of the dispenser shown in FIG. 1 as taken along the line 3—3 in the direction of the arrows.

The details of construction of the dispenser 1 are shown in FIGS. 1 and 3. As shown in FIGS. 1 and 3, the dispenser 1 consists of an outer envelope or shell 2, at least a portion of which must either expose or be permeable to the fabric conditioning agent which is in the form of a three-dimensional, consolidated mass, in this case a bar 4, which is dimensionally similar to a thin bar of soap. (The term "three-dimensional", as used herein, means a shape with a significant axis and/or thickness dimension, as opposed to a coating, where the thickness dimension is insignificant compared to the surface area.) It is convenient and economical to construct envelope 1 from cloth or fabric (whether woven or non-woven). Cotton/polyester (e.g. Dacron) twill is a particularly effective material of construction. The material of construction can also be varied to control the rate of migration or penetration of the chemicals utilized through the material. As noted previously, the envelope or shell 2 contains a bar 4 of solid or semi-solid material comprising a fabric-conditioning agent. This bar 4 is designed to have a melting or softening point within the range of the dryer temperature, all as more fully hereinafter described. In one practice of this invention the outer envelope or shell 2 of the dispenser 1 can be enclosed in a mesh overwrap 5 as shown in FIG. 2. The mesh overwrap 5 controls the direct contact between the dispenser 1 and clothes being dried and thus minimizes the staining or marking of clothes and serves to give the envelope additional rigidity when the bar 4 is in a softened state.

Fabric-Conditioning Agents

The fabric-conditioning agents useful in the practice of the present invention are those chemicals used for fabric-conditioning, particularly anti-static agents, which can be formed into a consolidated, three-dimensional solid or semi-solid mass which will soften when heated in a laundry dryer. Liquid fabric-conditioning agents are not practical for use in the present invention unless they are either mixed with or used to impregnate or coat a non-interfering carrier which is a heat softenable solid or unless they can be formed into a suitable gel.

A particularly useful class of fabric-conditioning agents comprises the quaternary ammonium salts. Desirably such quaternary salts will be the chlorides and will contain at least one and usually two $C_{12}$-$C_{24}$ fatty acid radicals (e.g. $C_{18}$ radicals). One preferred product is dimethyl di (hydrogenated tallow) ammonium chloride, whether used alone or in a mixture with other chemicals. If desired, two or more fabric-conditioning agents can be blended together, including combinations of quaternary ammonium salts with amide-type softening agents or anti-static agents. Additives can be used to improve bar-forming characteristics, modify the softening point of the bar and to control the rate of migration or penetration of the agents through the permeable surface of dispenser 1.

A particularly useful mixture of fabric-conditioning agents is a mixture of stearyl dimethyl benzyl ammonium chloride and dimethyl di (hydrogenated tallow) ammonium chloride in a weight ratio of 2-4:1.

In formulating any mass containing a fabric conditioner the mass should have a softening point within the operating temperature range of the dryer. It is important that the mass have a broad softening point range (i.e. it softens over a wide range of temperatures) as contrasted to a sharply defined or narrow melting point or softening point. By softening point range is meant the range of temperatures over which the mass is in the softened state, e.g. a state characterized by properties evidencing a non-flowable gel-like mass or a heavy or viscous mush, as opposed to a molten, flowable liquid. The existence of the mass as a non-flowable gel-like mass over a broad range of temperatures within the operating temperatures of a dryer is an important factor in controlling the rate of migration or penetration through the envelope or shell and thereby controlling marking and staining. Fabric conditioning agent formulations having a softening point range of at least 10 Centigrade °, and preferably at least 20 Centrigrade ° are preferred. It presently appears that optimum performance (including optimum cooperation between the softened mass and the permeable material enclosing the mass) is obtained when the fabric conditioning agent formulation is softened within the temperature range of 50°-90° C. It also appears to be neither necessary nor desirable for a transition from the softened state to a flowable liquid to occur within the 50°-90° C. range; it is generally preferred that the softened state be retained through as much of this range as possible. The existence of the softened state below 50° C. or above 90° C. can be desirable, but is ordinarily not essential to the objectives of this invention.

The present invention is further illustrated by the following specific example. Unless otherwise indicated, all parts and percentages are by weight.

EXAMPLE 1

72 parts of stearyl dimethyl benzyl ammonium chloride (melting point of 59°-65° C.), 25 parts of dimethyl di (hydrogenated tallow) ammonium chloride (melting point of 139°-144° C.) and 3 parts of coconut monoethanolamide (melting point of 62°-65° C.) were mixed together as powders to form an intimate mixture having a softening point range of 53°-85° C.

Two pieces of white 65% Dacron/35% cotton twill fabric measuring approximately 2 inches by 3 ⅝ inches were cut. Next, the two pieces of twill were sewn together in a facing relationship along three edges to form a small bag which was then turned inside out. 14.7 grams of the mixture of fabric-conditioning agents were then placed in the bag and the bag was sewn shut. The bag and its contents were then heated in a hot air oven (105°-110° C.) to cause the fabric-conditioning agents to soften and fuse together. Upon cooling, the contents of the bag formed a flat hard bar which adhered to the walls of the sealed bag or cloth envelope.

Next, the dispenser and a normal load of damp fabric were placed in a dryer and dried in the usual manner. When removed from the dryer, the fabrics were tested for static electricity and clinging. The results were excellent. No static or clinging were noted.

Repeated tests were made using, for test purposes, a dryer load including socks, towels and nylon tricot. The dryer cycle used was a heavy setting of 60 minutes duration. Static electricity was checked after each cycle by noting clinging and snapping or crackling electrical discharge. Controlled tests in which the fabric softener and anti-static agent were omitted consistently had static as evidenced by clinging, tangling, and visually observable electrical discharge. By contrast, fabrics dried in a dryer using the dispenser described above showed no static or clinging or tangling tendencies, even after 20 washing and drying cycles. Moreover, use of the present method to impart anti-static and softening properties to the fabric did not materially affect water absorbency as determined according to the procedure described in JAOCS, 42, 1084, December, 1965. By contrast, the effect on water absorbency for conventional, proprietary, water-based, fabric softeners used in the rinse cycle of the laundry process show pronounced adverse effects on water absorbency.

EXAMPLE 2

This example is the same as Example 1 with the exception that two pieces of white 65% Dacron/35% cotton twill fabric measuring approximately 4¼ inches by 6 inches were used with a fill of 30 grams of fabric-conditioning agent. Again no static or clinging were noted for over 20 drying cycles.

EXAMPLE 3

This example compares the anti-static properties of fabric treated in a machine dryer with a product similar to Example 1 to the anti-static properties of fabric treated in a washing machine with three proprietary fabric softener/anti-stats.

Conventional fabric softener/anti-stats were used as liquids which are added to clothes during the rinse cycle of the washing process. Such fabric softeners tend to impair the moisture absorbency of fabrics (e.g. towels and diapers) after repreated use and consequently, they are often used only periodically. This causes a see-saw effect on anti-static and other properties.

In this example, the anti-static properties of various fabric softeners were compared using nylon tricot fabric with the results being noted "before and after" rubbing with a nylon tricot block. The test method used was AATCC 115-1965 T (American Dyestuff Reporter, May 8, 1967). A fabric softener identical to that of Example 1 was used in every dryer cycle, while the conventional fabric conditioners were used only in cycle 1. The purpose of this test was to simulate the periodic use of the softener/anti-stats and to determine whether or not the effects of the softener/anti-stat would be maintained or would be removed by a single wash. The results which were obtained are shown in Table 1 which follows.

In each instance, the proprietary softeners were added according to their respective manufactures instructions. Controls 1 and 3 were added during the rinse cycle and Control 2 was added during the wash cycle.

TABLE I

ANTISTATIC PROPERTIES OF NYLON TRICOT

| | | Example 1 | | Control 1 [1] | | Control 2 [2] | | Control 3 [3] | |
|---|---|---|---|---|---|---|---|---|---|
| | | Before | After | Before | After | Before | After | Before | After |
| | Start (No Treatment) | ++ | ++ | ++ | ++ | ++ | ++ | ++ | ++ |
| Wash & Dry | Cycle-1 | − | ± | + | ± | ++ | ++ | − | − |
| Wash & Dry | Cycle-2 | − | + | ++ | ++ | ++ | ++ | − | − |
| Wash & Dry | Cycle-3 | − | − | ++ | ++ | ++ | ++ | ++ | ++ |
| Wash & Dry | Cycle-4 | − | − | ++ | ++ | ++ | ++ | ++ | ++ |
| Wash & Dry | Cycle-5 | − | − | ++ | ++ | ++ | ++ | ++ | ++ |

LEGEND
[1] NuSoft, a product of Best Foods, a division of CPC International
[2] Rain Barrel, a product of S.C. Johnson & Sons, Inc.
[3] Downy, a product of Proctor & Gamble Company
− No static (Cling)
± None in 2 out of 3 Test Pieces
+ Marginal
++ Heavy Static The relative moisture absorbency was also determined with regard to fabrics treated with the fabric softeners of Example 3. The test procedure used was the rewettability or wicking test method reported by Grim et al, JOACS, 42, 1084, December, 1965. Wick height was measured after ten minutes. Moisture absorbency was poor after the first and second washing and drying cycles for fabrics treated with Controls 1 and 2. The moisture absorbency of fabrics treated with Control 3 was poor after the first washing and drying cycle, but recovered substantially after the second washing and drying cycle. By contrast, the product of this invention (i.e. Example 1) surprisingly gave no measurable impairment in moisture absorbency even after the fifth washing and drying cycle. It is hypothesized that with the product and method of this invention only the surface of the fabric is coated with the fabric-conditioning agent whereas with conventional products (which are used as liquids) the cationic softening agent is absorbed by or on all of the fibers of the fabric.

EXAMPLE 4

This example compares the consumption per cycle (grams of conditioning agent consumed per cycle) for reusable dispensers of solid fabric conditioning agent with and without a nylon mesh overwrap.

The mixture of fabric conditioning agents used was the same as that described in Example 1. The procedure for preparing the dispensers was the same as described in Example 1. Four dispensers measuring approximately 2 inches by 3⅝ inches containing 14.7 grams of the mixture of fabric conditioning agents and two dispensers measuring approximately 4¼ inches by 6 inches containing 30.0 grams of the mixture of fabric conditioning agents were prepared.

Two of the 2 inches by 3⅝ inches dispensers and one of the 4¼ inches by 6 inches dispensers were enclosed in a nylon mesh overwrap.

Next, each of the six dispensers was tested separately by placing it in a dryer along with a normal load of damp fabric and drying the fabric in the usual manner. This drying cycle was repeated 20 times with each dispenser and the consumption rate was determined for each cycle by weighing the dispenser before and after each cycle and determining the weight loss.

The average consumption per cycle over the 20 cycle test was approximately one-half for the dispensers with the nylon mesh overwrap as compared to the dispensers without the nylon mesh overwrap. The data is summarized in Table II.

The dispensers enclosed in the nylon mesh overwrap also showed a substantial advantage over their counterparts without the nylon mesh overwrap in not folding over onto themselves during tumbling in the dryer.

All of the above figures are weight loss in grams per cycle.

What is claimed is:

1. An article for conditioning fabrics in a machine clothes dryer by contact of the fabrics with a fabric-conditioning agent supplied by said article, said article characterized by having:

(a) fabric conditioning agent in a three-dimensional consolidated reusable mass that is solid at normal room temperature and softens at the elevated temperatures reached during normal operation of a machine clothes dryer; said mass having a softening range of at least 10 Centigrade degrees;

(b) a dispenser body surrounding or enclosing the fabric conditioning agent;

(c) said dispenser body including a permeable outer surface through which only a small amount of said enclosed fabric conditioning agent can pass when it is softened by heating of said article in a dryer, thereby allowing the enclosed fabric-conditioning agent to act as a long lasting reservoir for fabric conditioning agent which, after it passes through the permeable surface, is transferred to the fabric being treated by contact between the fabric and the permeable surface of the article; and (d) said article being capable of substantial reuse in conditioning different batches of fabric without replenishing the fabric conditioner of paragraph (a) hereof.

2. An article of claim 1 wherein said permeable surface is made of cloth.

3. An article of claim 2 wherein said cloth is a cotton/polyester cloth.

4. An article of claim 3 wherein the dispenser body is a cloth bag or envelope.

5. An article of claim 4 wherein the fabric conditioning agent comprises an anti-static agent.

6. An article of claim 4 wherein the agent contained in said bag comprises dimethyl di (hydrogenated tallow) ammonium chloride.

7. An article of claim 4 wherein the agent contained in said bag is a mixture consisting essentially of stearyl dimethyl benzyl ammonium chloride and dimethyl di (hydrogenated tallow) ammonium chloride in a weight ratio of about 2-4:1.

8. An article of claim 4 wherein the cloth envelope or bag is enclosed within a mesh overwrap.

9. An article of claim 4 wherein the mesh overwrap is nylon.

* * * * *

TABLE II

TWENTY CYCLE CONSUMPTION TESTS WITH AND WITHOUT NYLON MESH OVERWRAP OF EXAMPLE 4

| | 2" × 3⅝" DISPENSERS | | | | 4¼" × 6" DISPENSERS | |
|---|---|---|---|---|---|---|
| | WITHOUT NYLON MESH OVERWRAP Wt.Loss,Grams | | WITH NYLON MESH OVERWRAP Wt.Loss,Grams | | WITHOUT NYLON MESH OVERWRAP Wt.Loss,Grams | WITH NYLON MESH OVERWRAP Wt.Loss,Grams |
| CYCLE | A | B | C | D | E | F |
| 1 | 0.16 | 0.14 | 0.12 | 0.10 | 0.54 | 0.19 |
| 2 | 0.53 | 0.50 | 0.04 | 0.04 | 1.76 | 0.13 |
| 3 | 0.61 | 0.58 | 0.03 | 0.05 | 1.58 | 0.24 |
| 4 | 0.71 | 0.57 | 0.08 | 0.10 | 1.80 | 0.38 |
| 5 | 0.59 | 0.58 | 0.03 | 0.10 | 1.39 | 0.31 |
| 6–10 | 0.25 | 0.64 | 0.23 | 0.28 | 1.61 | 0.64 |
| 11–15 | 0.94 | 0.68 | 0.30 | 0.31 | 0.76 | 0.60 |
| 16–20 | 0.48 | 0.47 | 0.29 | 0.37 | 0.59 | 0.68 |
| TOTAL | 10.95 | 10.74 | 4.40 | 5.09 | 21.87 | 10.85 |
| Per/cycle over 20 cycles | 0.55 | 0.54 | 0.22 | 0.25 | 1.09 | 0.54 |